US006877175B1

(12) United States Patent
Jeffries et al.

(10) Patent No.: US 6,877,175 B1
(45) Date of Patent: Apr. 12, 2005

(54) METHOD FOR SECURING BED COVERINGS AND APPARATUS THEREFOR

(76) Inventors: Deidra B. Jeffries, 25408 Via Escobar, Valencia, CA (US) 91355; Sandra B. Brazier, 5445 Lake Lindero Dr., Agoura Hills, CA (US) 91301

( * ) Notice: Subject to any disclaimer, the term of this patent is extended or adjusted under 35 U.S.C. 154(b) by 24 days.

(21) Appl. No.: 10/782,176

(22) Filed: Feb. 19, 2004

Related U.S. Application Data

(63) Continuation-in-part of application No. 10/411,740, filed on Apr. 11, 2003, now Pat. No. 6,704,955.

(51) Int. Cl.[7] ..... A47C 21/02

(52) U.S. Cl. ..... 5/504.1; 5/498; 5/658; 24/72.5

(58) Field of Search ..... 5/494, 496, 498, 5/499, 504.1, 658; 24/72.5

(56) References Cited

U.S. PATENT DOCUMENTS

| | | | | | |
|---|---|---|---|---|---|
| 2,223,412 | A | * | 12/1940 | Gartz | 24/72.5 |
| 2,284,778 | A | * | 6/1942 | Treiber | 5/498 |
| 2,321,394 | A | * | 6/1943 | King | 24/72.5 |
| 2,326,399 | A | * | 8/1943 | Shields | 24/72.5 |
| 2,459,497 | A | * | 1/1949 | Calabro | 24/72.5 |
| 2,930,053 | A | * | 3/1960 | Nowels | 5/498 |
| 2,979,737 | A | * | 4/1961 | Pierre | 5/498 |
| 4,199,831 | A | * | 4/1980 | Muller | 5/411 |
| 4,222,139 | A | * | 9/1980 | Svedberg-Reker et al. | 5/498 |
| 4,521,970 | A | * | 6/1985 | Jester | 33/662 |
| 4,698,880 | A | * | 10/1987 | Hamm | 24/72.5 |
| 4,782,543 | A | * | 11/1988 | Hutton et al. | 5/658 |
| 4,891,856 | A | * | 1/1990 | Thornhill | 5/496 |
| 5,014,399 | A | * | 5/1991 | Grisel | 24/72.5 |
| 5,072,470 | A | * | 12/1991 | Lysiak | 5/496 |
| 5,148,560 | A | * | 9/1992 | Torres | 5/496 |
| 5,179,743 | A | * | 1/1993 | Lanman | 5/498 |
| D336,810 | S | * | 6/1993 | Caraway | D6/607 |
| 5,467,491 | A | * | 11/1995 | Griffith | 5/658 |
| 5,651,153 | A | * | 7/1997 | Goodrich | 5/498 |
| D387,602 | S | * | 12/1997 | Cerdan | D6/607 |
| 6,161,235 | A | * | 12/2000 | Smith et al. | 5/504.1 |
| D436,489 | S | * | 1/2001 | Farrugia | D6/607 |
| 6,185,766 | B1 | * | 2/2001 | Farrugia | 5/498 |
| 6,295,670 | B1 | * | 10/2001 | Schieberl | 5/504.1 |
| 6,557,194 | B1 | * | 5/2003 | Jeffries et al. | 5/504.1 |
| D481,579 | S | * | 11/2003 | Colbert et al. | D6/607 |
| 6,704,955 | B1 | * | 3/2004 | Jeffries et al. | 5/504.1 |
| 2002/0062522 | A1 | * | 5/2002 | Deckert | 5/504.1 |

* cited by examiner

*Primary Examiner*—Robert G. Santos
(74) *Attorney, Agent, or Firm*—Ted Masters

(57) ABSTRACT

A method and apparatus for attaching a bed covering to a bed includes an elongated member having an anchor at one end and a connector at the other end. The elongated member is placed between the mattress and the box spring with the anchor at the head of the bed and the connector near the foot of the bed, the connector being attached to the bed covering. When pulled toward the foot of the bed, the anchor firmly wedges itself between the mattress and box spring preventing the connector from moving and thereby keeping the bed covering in place.

3 Claims, 6 Drawing Sheets

METHOD FOR SECURING BED COVERINGS AND APPARATUS THEREFOR

CROSS REFERENCE TO RELATED APPLICATION

This application is a Continuation-In-Part of application Ser. No. 10/411,740, filed Apr. 11, 2003 now U.S. Pat. No. 6,704,955, which is included herein in its entirety by reference.

TECHNICAL FIELD

The present invention pertains generally to beds and bed coverings, and in particular to a method and apparatus for fastening a bed covering such as a sheet or blanket so that the bed coverings will not pull out from under the mattress.

BACKGROUND OF THE INVENTION

Inventions relating to bed coverings and means for securing same are well known in the art. For example, U.S. Pat. No. 2,979,737 depicts a sheet holder for maintaining sheets or other similar articles of bed clothing in a customarily desired position on a bed. The device holds the articles of bed clothing under tension in a desired position.

U.S. Pat. No. 3,350,726 is directed to a mattress retainer having a support. Corner guards are secured adjacent lower ends thereof to corners of the support. A harness is secured to each of the corner guards at a medial portion thereof, and the upper portions of the corner guards serving to restrain the mattress from sliding with respect to the support.

U.S. Pat. No. 4,199,831 pertains to a mattress securing apparatus which utilizes four right angle corner guards disposed at the corners of a mattress resting on a device having a mattress supporting surface therein such as a box spring to prevent lateral displacement of the mattress relative to the supporting surface. A plate, affixed to each corner guard and perpendicular to the right angle leg portions thereof, is located between the supporting surface and the lowermost surface of the mattress. A harness, including an elastic member is located in crisscross fashion, connecting the four corner guards together, urging the corner guards in touching engagement with the corners of the mattress and mattress supporting device. A pair of cords flexibly connect adjacent pairs of corner guards together preventing the corner guards from accidental dislodgement when one corner of the mattress is lifted. A securing plate is utilized to maintain the area of the harness together where the harness elements cross or engage each other near the mid area of the mattress.

U.S. Pat. No. 4,782,543 shows a device for attaching flat bed sheets and other bed covers to a waterbed and for retaining them neatly in a desired position atop the mattress of a waterbed. The device includes a fastener including a slot and stud combination, attached to an elastic connector extending from the fastener to a retainer portion of relatively stiff construction and extending parallel with the bottom of the waterbed, beneath the mattress thereof. The retainer may include openings therethrough, or in another embodiment may include suction cups for gripping the lower surface of the mattress.

U.S. Pat. No. 4,891,856 includes a grasping system for use on contoured sheets to keep sheets tucked and tight under mattress. The system comprises two independent terry elastic straps having a nylon insert clip attached to each end and an adjustable slide on each front end of the straps. Both straps crisscross along bottom surface portion of the mattress.

U.S. Pat. No. 5,033,139 illustrates a device to secure the top sheet of bedding from being accidentally pulled out at the foot of the bed. An elongated piece of plastic material is provided for placement between the mattress and the box springs of a bed, wherein the end of the tucked-in top sheet of the bed is in contact with one side of the elongated piece of material, and the other side of the elongated piece is in contact with the box springs. The top sheet securing device is constructed of materials which have a high coefficient of static friction such that the weight of the mattress pressing down upon the tucked-in top sheet is sufficient to provide compression of the plastic material between the top sheet and lower box springs that the top sheet is held in position against the unintentional or accidental pulling out. The top sheet securing device may be alternately made of a thin sheet of vinyl plastic or a thickness of open or closed cell low density polyurethane foam, or a combination of vinyl plastic and polyurethane foam.

U.S. Pat. No. 5,072,470 discloses a device for holding any number or combination of bedclothes in a fixed position on a bed. The device comprises three component parts all positioned entirely under the uppermost cushioned structure of the bed: a) an anchor member having a plurality of cooperable fastening means disposed generally at peripheral points on it, the fastening means counter poised against one another, b) a plurality of elasticized retaining members having length adjusting mechanism and cooperable fastening means to those on the anchoring member, and c) a plurality of clamps having pivotally connected gripping segments, a closure forcing element and cooperably insertable associated independent coupling elements, said clamps connected to the retaining members. Any number of bedclothes, at any point adjacent to the lower edge of the uppermost cushioned structure, are wrapped around an associated independent coupling element and the associated independent coupling element and bedclothes are then inserted into the clamps. The bedclothes are then tucked under the uppermost cushioned structure of the bed and the elasticized retaining hand is then fastened to the anchoring member the cooperable fastening means. The bedclothes are fastened to the device at opposite sides of the bed and are so held in place by the device through opposing counterpoised force.

U.S. Pat. No. 6,185,766 comprises a bed covering anchor having a pair of adjustable length crossing support straps to allow attachment to the area of the corners of a variety of sizes of bed covering placed on bed mattresses. Elastic straps are engaged at the ends of the crossing straps and have a grasping device at one or both ends of each elastic strap to grasp the covering and provide a retracting force to keep the covering taut on the mattress. One or more lateral support straps may also be attached to the cover to keep the longitudinal edges of the covering taut at the points of attachment.

U.S. Pat. No. 6,295,670 describes a bed covering retention apparatus comprising a planar anchor plate having a proximal portion and a distal portion, an upper surface and a lower surface, a first and a second anchor point at the proximal end of the anchor plate to which first and second elastic bands are removably connected. The first and second elastic bands have a proximal end and distal end and extend from the anchor points along the bottom surface of the anchor plate until each emerges upwardly through respective apertures to the top surface of the anchor plate. The bands further include releasable jaws having an adjustable opening and adjustable tension so that the jaws will clamp securely to sheets and covers of varying thicknesses. The elastic bands are of differing lengths, one being suited to clamping to an innermost bed covering and the other for clamping to coverings above the innermost covering.

U.S. Pat. No. 6,557,194 illustrates a method for attaching a top bed covering to a bed, includes (a) providing a bed having a mattress disposed on top of a box spring, the mattress and box spring having adjacent side walls, (b) providing a top bed covering, (c) providing a device for attaching a bed covering to a bed, the device including: an elongated member having a first end and an opposite second end; a connector attached to the first end; an anchor connected to the second end; (d) positioning the anchor so that it simultaneously abuts the side walls of both the mattress and the box spring, (e) positioning the elongated member between the mattress and the box spring, and, (f) attaching the connector to the top bed covering. In an alternative embodiment, the anchor has nubbed sides and is placed horizontally between the mattress and the box spring or floor.

BRIEF SUMMARY OF THE INVENTION

The present invention is directed to a method and device for securing bed coverings, and specifically to a method and device which connects top or bottom bed coverings, such as sheets or blankets, so that the bed coverings will not pull out from under the mattress. The device is installed between the mattress and the box spring, and comprises an elongated member such as a strap, having an anchor at one end, and a connector at the other end.

Prior art inventions require that the strap attach to the sheet or other bed covering at both ends of the strap. With the present invention, once the anchor is in place, an easy, onetime-only event, attachment is required at only at one end to secure the bed covering in place. This permits ease in changing the sheets preventing potential back injuries, saving time and energy.

The present invention is easily secured to and prevents a top or bottom sheet or blanket from becoming untucked. The present invention permits attachment with the same ease as making the bed with the same or less risk of injury as making the bed conventionally.

The present invention minimizes the prospect of injury because it eliminates the need to remake the bed daily based on an individual's active nightly sleep pattern or more often depending on one's bed-making or changing schedule. Adults and those with back pain are assisted by an invention which permits easy bed-making because all that is needed is to pull and smooth the sheets and blankets, not recenter and re-tuck sheets and blankets. Additionally, the present invention permits easy bed-making by children which assists the parents in this housekeeping task, teaches responsibility, and creates self-sufficiency in even the youngest children. With the top sheet strap and blankets in place, children and adults remain warm-a significant health benefit.

In accordance with a preferred embodiment of the invention, a method for attaching a bed covering to a bed, includes:

(a) providing a bed having a mattress disposed on top of a box spring, the mattress having a head portion and an opposite foot portion, and the box spring having a head portion disposed adjacent to the head portion of the mattress and a foot portion disposed adjacent to the foot portion of the mattress;

(b) providing a bed covering;

(c) providing a device for attaching the bed covering to the bed, the device including:

an elongated member having a first end and an opposite second end;

a connector attached to the first end;

an anchor connected to the second end;

(d) positioning the elongated member between the mattress and the box spring so that the anchor resides adjacent to the head portion of the mattress wherein if the elongated member is pulled toward the foot portion of the mattress the anchor wedges between the mattress and the box spring; and, (e) attaching the connector to the bed covering near the foot portion of the mattress.

The method further including:

in step (c), connector being a garter connector.

The method further including:

in step (c), the elongated member being stretchable.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
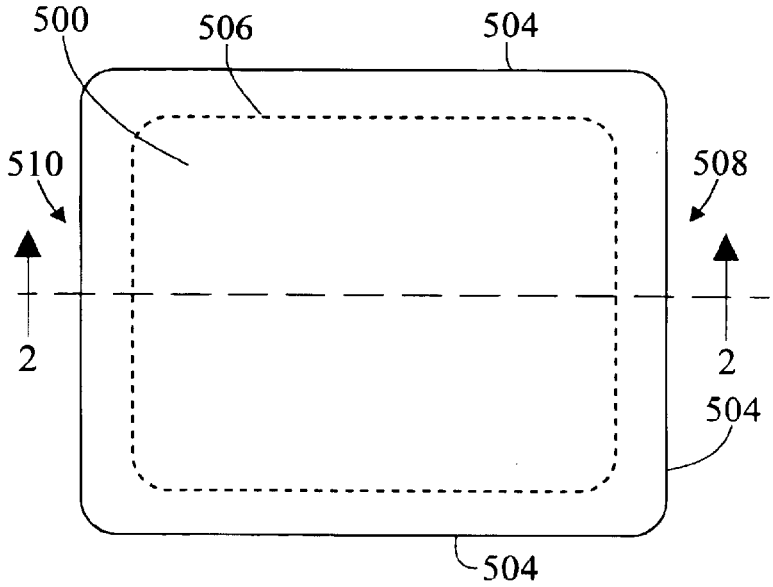
Fig. 1 PRIOR ART
FIG. 1 is a top plan view of a prior art bed comprising a mattress residing on top of a box spring.
Figure 2:
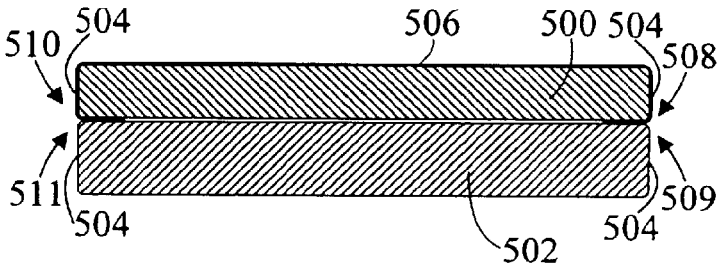
Fig. 2 PRIOR ART
FIG. 2 is cross sectional view along the line 2—2 of FIG. 1.

Referring initially to FIGS. 1 and 2, there are illustrated top plan and cross sectional views respectively of a prior art bed comprising a mattress 500 residing on top of a box spring 502. Mattress 500 and box spring 502 having four sets of adjacent vertical side walls 504. The side walls 504 of mattress 500 are disposed vertically adjacent to the side walls 504 of box spring 502. A bottom bed cover 506, such as a fitted sheet, is fitted around mattress 500 in the conventional manner with the edges of the bottom bed covering 506 pulled around the edges of the mattress 500. The bottom bed covering 506 could also be a flat sheet which is tucked under mattress 500. Mattress 500 has a head portion 508 and an opposite foot portion 510, and box spring 502 has a head portion 509 disposed adjacent to head portion 508 of mattress 500 and a foot portion 511 disposed adjacent to foot portion 510 of mattress 500. The illustrated bed is rectangular, however it may be appreciated that other shapes such as circular are also possible. It is noted that bottom bed covering 506 could be a non-fitted sheet which must be tucked in between mattress 500 and box spring 502.

Figure 3:
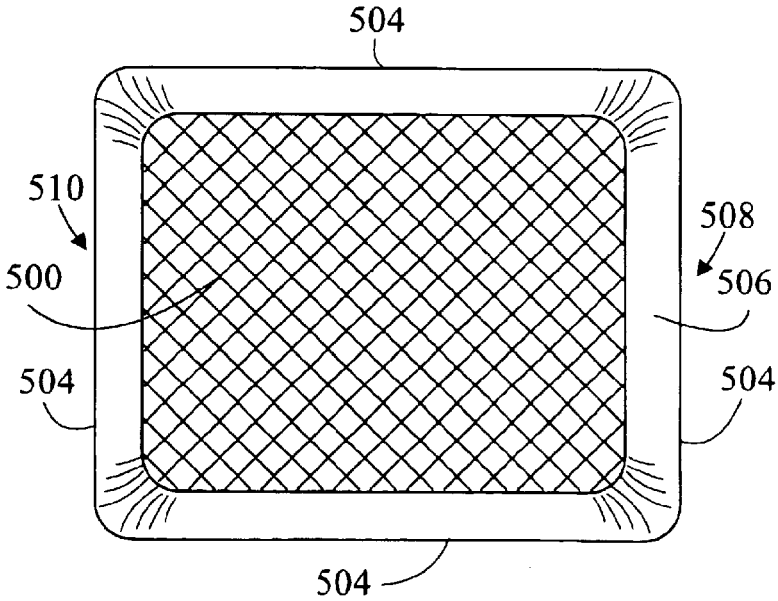
Fig. 3 PRIOR ART
FIG. 3 is a bottom plan view of the mattress.

FIG. 3 is a bottom plan view of mattress 500 showing fitted bottom bed covering 506.

Figure 4:
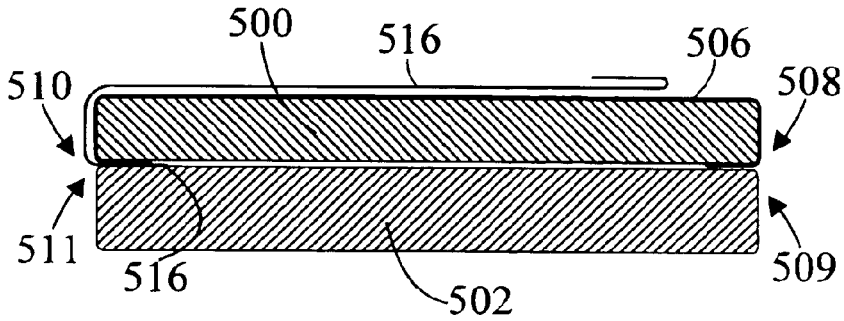
Fig. 4 PRIOR ART
FIG. 4 is a cross sectional view of the mattress and box spring showing both a top and bottom bed covering.

FIG. 4 is a cross sectional view of mattress 500 and box spring 502 showing a top bed covering 516 and bottom bed covering 506. Top bed covering 516 is typically a flat top sheet which is placed over the bottom bed covering 506 and tucked under the edge of mattress 500. Mattress 500 and box spring 502 have side walls 504. When top bed covering 516 is installed on mattress 500, top bed covering 516 has a foot portion or area which resides on the underside of mattress 500 at the foot portion 510 of mattress 500. It is noted that, top bed covering 516 could also be a blanket, comforter, or the like. Both top bed covering 516 and bottom bed covering 506 are typically tucked between mattress 500 and box spring 502 at the foot portion 510 of mattress 500.

Figure 5:
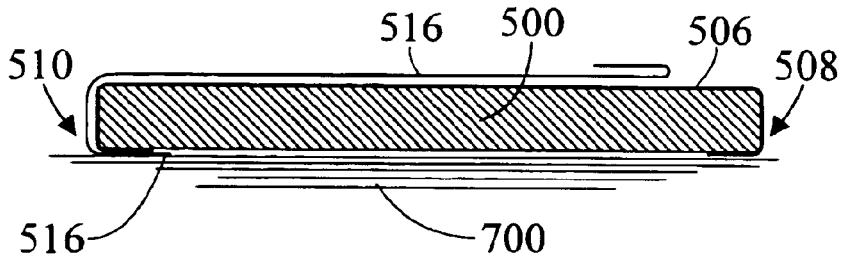
Fig. 5 PRIOR ART
FIG. 5 is a cross sectional view of a prior art mattress residing on top of a support surface.

FIG. 5 is a cross sectional view of mattress 500 residing on top of a support surface 700. In this prior art embodiment, mattress 500 is not placed on top of a box spring 502, but is rather placed directly on a support surface 700 such as the floor. An air mattress 500 placed on the floor 700 to accommodate an overnight guest is representative of this prior art embodiment. As with FIG. 4, top bed covering 516 is typically a flat top sheet which is placed over the bottom bed covering 506 and tucked under the edge of mattress 500. Mattress 500 has a side wall 504. When top bed covering 516 is installed on mattress 500, top bed covering 516 has a foot portion or area which resides on the underside of mattress 500 at the foot portion 510 of the mattress.

Figure 6:
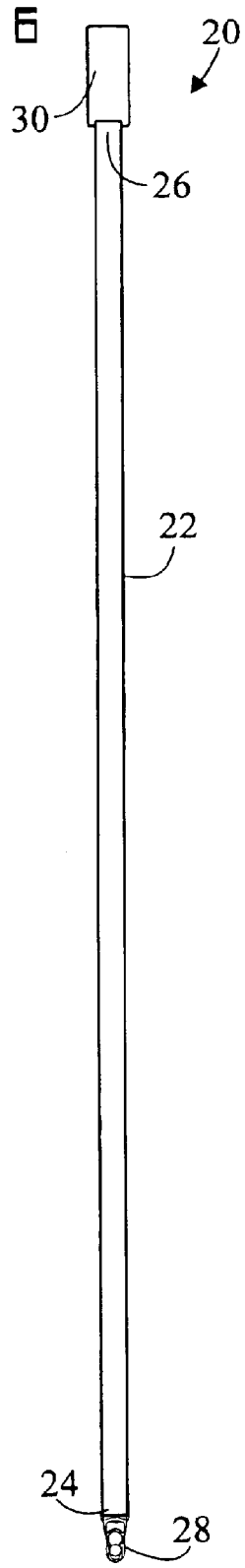
FIG. 6 is an enlarged top plan view of a device for attaching a bed covering to a bed in accordance with the present invention.

FIG. 6 is an enlarged top plan view of a device 20 for attaching a bed covering to a bed in accordance with the present invention. Device 20 includes an elongated member 22 having a first end 24 and an opposite second end 26. A connector 28 is attached to first end 24, the connector 28 being selectively attachable to a bed covering 506 or 516 (refer to FIGS. 11 and 12). An anchor 30 is connected to second end 26. In the shown embodiment, elongated member 22 is a strap, however it may be appreciated that elongated member 22 could also be a rope, wire, cable, cord, or the like. In a preferred embodiment, elongated member 22 is flexible.

Figure 7:
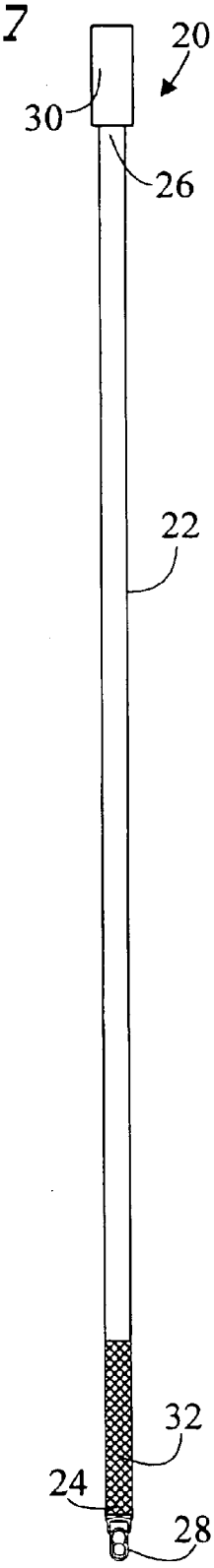
FIG. 7 is an enlarged top plan view of a variation of the device.

FIG. 7 is an enlarged top plan view of a variation of device 20. In this embodiment elongated member 22 is longitudinally stretchable. One manner of achieving this effect is to include an elastic portion 32. This embodiment is useful in allowing one length elongated member serve different length beds. While elongated member 22 will stretch, it still serves to hold the bed covering essentially in place.

Figure 8:
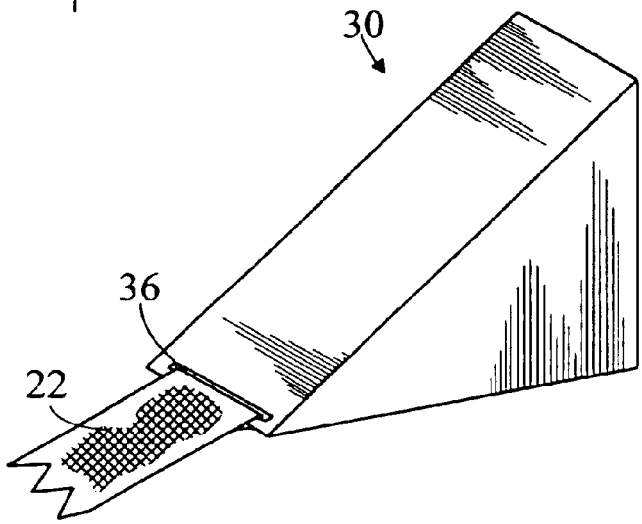
FIG. 8 is an enlarged perspective view of an anchor connected to an elongated member.

FIG. 8 is an enlarged perspective view of anchor 30 connected to elongated member 22. Elongated member 22 passes through a slot 36 in anchor 30 to effect attachment of anchor 30 to elongated member 22. In the shown embodiment, anchor 30 is wedge-shaped, however it may be appreciated that anchor 30 could be disc-shaped, spherical, hemi-spherical, rectangular, L-shaped, V-shaped, or any other shape which will lodge between mattress 500 and box spring 502 at head portions 508 and 509 respectively when first end 24 of elongated member 22 is pulled toward foot portion 510 of mattress 500. In an embodiment of the invention, anchor 30 is fabricated from a polymer; however, other ridged or semi-ridged materials could also be utilized.

Figure 9:
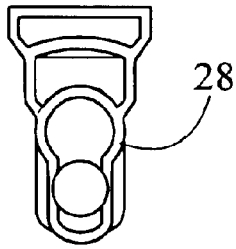
FIG. 9 is an enlarged top plan view of a connector.

FIG. 9 is an enlarged top plan view of connector 28. In the shown embodiment, connector 28 is a garter connector which is well known in the art. A captive flexible tab, typically fabricated from rubber, captures and holds the bed coverings against a metal frame work. This type of connector has the advantage that it will not tear or penetrate the bed coverings. It may be appreciated however, that while the shown garter-type connector is preferred, other connectors such as suspender clamps, pins, Velcro, and the like could also be employed.

Figure 10:
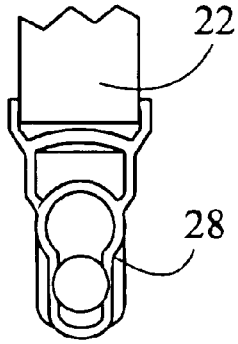
FIG. 10 is an enlarged top plan view of the connector attached to the elongated member.

FIG. 10 is an enlarged top plan view of connector 28 attached to elongated member 22.

Figure 11:
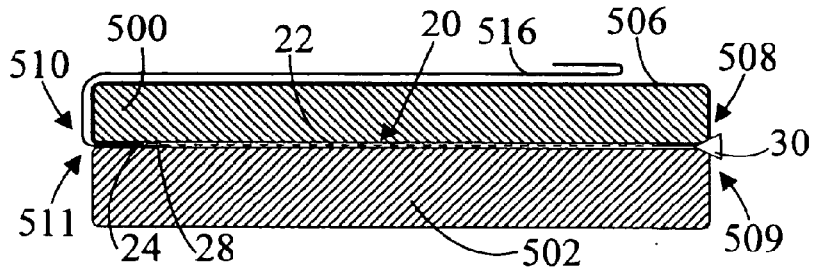
FIG. 11 is a cross sectional view of the device installed between the mattress and the box spring and attached to a bed covering.
Figure 12:
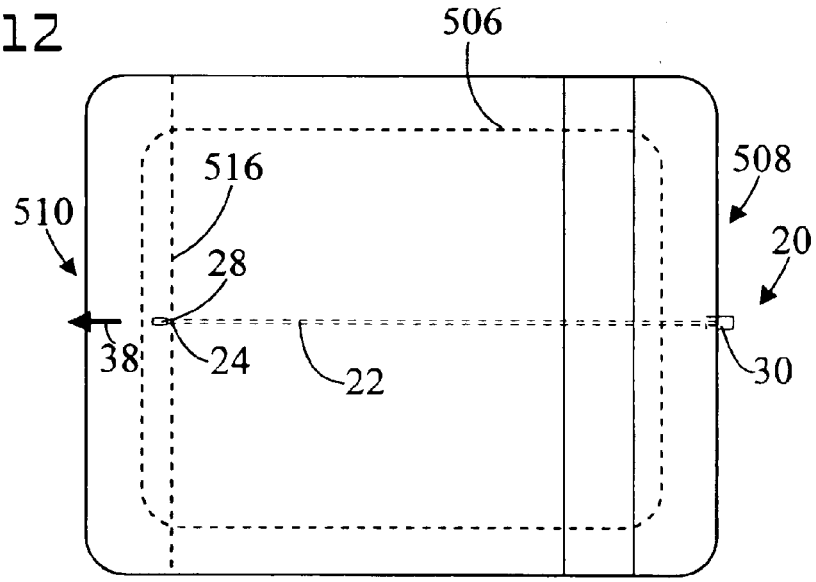
FIG. 12 is a top plan view of the device installed on the bed.

FIGS. 11 and 12 are cross sectional and top plan views respectively of device 20 installed on a bed between mattress 500 and box spring 502 with connector 28 attached to top bed covering 516. In the shown embodiment bottom bed covering 506 is a fitted sheet, however bottom bed covering 506 could also be a non-fined sheet which must be tucked in between mattress 500 and box spring 502. Elongated member 22 is positioned between mattress 500 and the box spring 502 so that anchor 30 resides adjacent to head portion 508 of mattress 500 wherein if first end 24 (having connector 28) of elongated member 22 is pulled in direction 38 toward foot portion 510 of mattress 500, anchor 30 wedges between mattress 500 and the box spring 502 thereby preventing further movement of connector 28, which is attached to bed covering 516 and/or 566 near foot portion 510 of mattress 500. With connector 28 effectively locked in place by anchor 30, attached bed coverings 516 and/or 506 will not pull out from under mattress 500. The length of elongated member 22 is selected to extend from the head of the bed to the tucked in bed covering 516 or 506 at the foot of the bed. It is noted that "anchor 30 resides adjacent to head portion 508 of mattress 500" means that anchor 30 is placed near the junction of head portion 508 of mattress 500 and head portion 509 of box spring 502 so that when elongated member 22 is pulled toward the foot 510 of mattress 500, anchor 30 will wedge itself between mattress 500 and box spring 502 and thereby limit the travel of connector 28.

Figure 13:
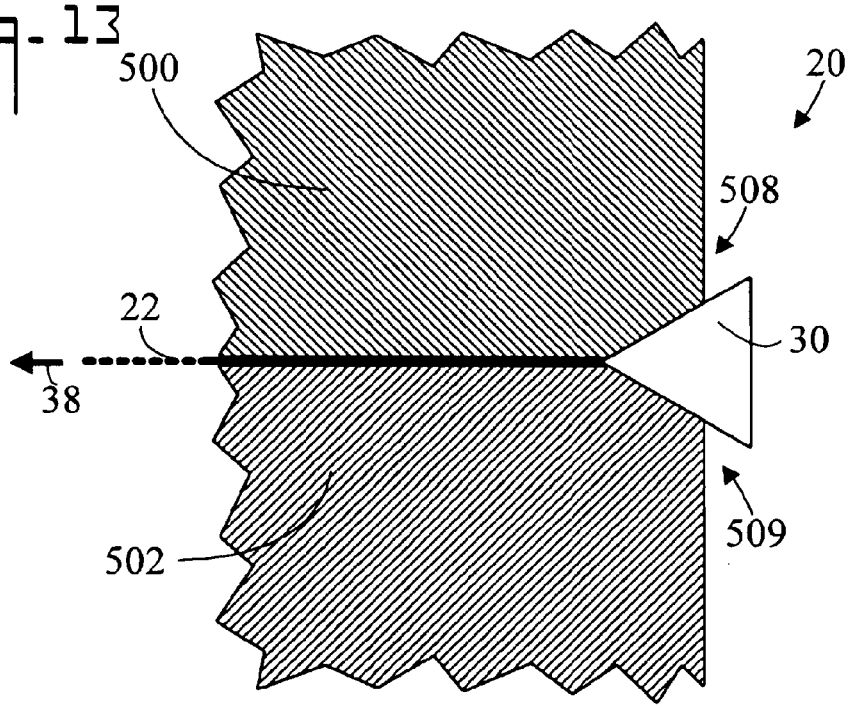
FIG. 13 is an enlarged cross sectional view of area 13 of FIG. 11; and, FIG. 14 is a cross sectional view of the device installed on the a bed between a mattress and a support surface.

FIG. 13 is an enlarged cross sectional view of area 13 of FIG. 11 showing how anchor 30 is captured between mattress 500 and box spring 502 as elongated member 22 is pulled in direction 38.

Figure 14:
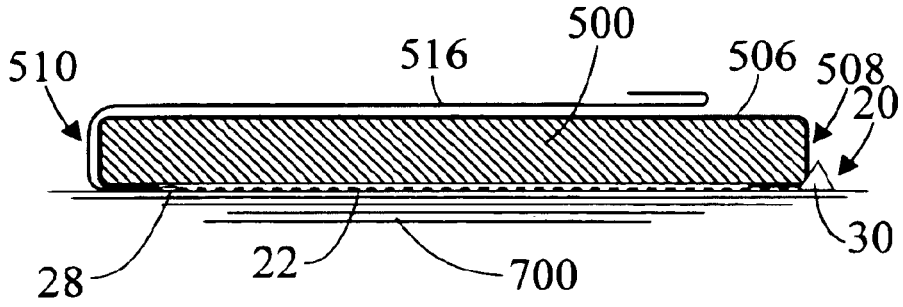

FIG. 14 is a cross sectional view of device 20 installed on a bed between a mattress 500 and a support surface 700 such as the floor. This embodiment is similar to the mattress 500/box spring 502 embodiment except anchor 30 wedges between mattress 500 and support surface 700.

In terms of use, a method for attaching a bed covering 516/506 to a bed, includes:

(a) providing a bed having a mattress 500 disposed on top of a box spring 502, the mattress 500 having a head portion 508 and an opposite foot portion 510, and the box spring 502 having a head portion 509 disposed adjacent to the head portion 508 of the mattress 500 and a foot portion 511 of the box spring disposed adjacent to the foot portion 509 of the mattress 500;

(b) providing a bed covering 516/506;

(c) providing a device 20 for attaching the bed covering to the bed, device 20 including:

an elongated member 22 having a first end 24 and an opposite second end 26;

a connector 28 attached to first end 24;
an anchor 30 connected to second end 26;

(d) positioning elongated member 22 between mattress 500 and box spring 502 so that anchor 30 resides adjacent to head portion 508 of mattress 500 wherein if said elongated member 22 is pulled toward foot portion 510 of mattress 500 anchor 30 wedges between mattress 500 and box spring 502; and, (e) attaching connector 30 to the bed covering near foot portion 510 of mattress 500.

The method further including:
in step (c), connector 28 being a garter connector.

The method further including:
in step (c), elongated member 22 being stretchable.

The method further including:

after step (d) and before step (e), pulling elongated member 22 toward foot portion 510 of mattress 500 so that anchor 30 wedges between mattress 500 and box spring 510.

It may be appreciated that the above cited method may also be used wherein the box spring 502 is replaced by a support surface 700 such as the floor as is illustrated in FIG. 14.

The preferred embodiments of the invention described herein are exemplary and numerous modifications, variations, and rearrangements can be readily envisioned to achieve an equivalent result, all of which are intended to be embraced within the scope of the appended claims.

We claim:

1. A method for attaching a bed covering to a bed, comprising:

(a) providing a bed having a mattress disposed on top of a box spring, said mattress having a head portion and an opposite foot portion, and said box spring having a head portion disposed adjacent to said head portion of said mattress and a foot portion disposed adjacent to said foot portion of said mattress;

(b) providing a bed covering;

(c) providing a device for attaching said bed covering to said bed, said device including:
an elongated member having a first end and an opposite second end;
a connector attached to said first end;
an anchor connected to said second end;

(d) positioning said elongated member between said mattress and said box spring so that said anchor resides adjacent to said head portion of said mattress wherein if said elongated member is pulled toward said foot portion of said mattress said anchor wedges between said mattress and said box spring;

(e) after step (d) and before step (f), pulling said elongated member toward said foot portion of said mattress so that said anchor wedges between said mattress and said box spring; and, (f) attaching said connector to said bed covering near said foot portion of said mattress.

2. A method for attaching a bed covering to a bed, comprising:

(a) providing a bed having a mattress disposed on top of a support surface, said mattress having a head portion and an opposite foot portion;

(b) providing a bed covering;

(c) providing a device for attaching said bed covering to said bed, said device including:
an elongated member having a first end and an opposite second end;
a connector attached to said first end;
an anchor connected to said second end;

(d) positioning said elongated member between said mattress and said support surface so that said anchor resides adjacent to said head portion of said mattress wherein if said elongated member is pulled toward said foot portion of said mattress said anchor wedges between said mattress and said support surface;

(e) after step (d) and before step (f), pulling said elongated member toward said foot portion of said mattress so that said anchor wedges between said mattress and said support surface; and, (f) attaching said connector to said bed covering near said foot portion of said mattress.

3. A device for attaching a bed covering to a bed, the bed having a mattress disposed on top of a box spring, the mattress having a head portion and an opposite foot portion, a length, and two parallel sides, and the box spring having a head portion disposed adjacent to the head portion of the mattress and a foot portion disposed adjacent to the foot portion of the mattress, said device comprising:

a single elongated member having a first end and an opposite second end, said elongated member having a length which is greater than one half the length of the mattress;

a connector attached to said first end;

an anchor attached to said second end, said anchor being loose and not fixedly attachable to the bed covering, the mattress, or the box spring;

wherein said elongated member is configured to be positioned between the mattress and the box spring substantially parallel to the sides of the mattress so that said anchor resides substantially at the middle of to the head portion of the mattress and wedges between the mattress and box spring when said elongated member is pulled toward the foot portion of the mattress; and, wherein said connector may be attached to the bed covering near the foot portion of the mattress.

* * * * *